US005286189A

United States Patent [19]

Goss

[11] Patent Number: 5,286,189

[45] Date of Patent: Feb. 15, 1994

[54] DETACHABLE IGNITOR TIP FOR A BURNER ASSEMBLY

[76] Inventor: Charles T. Goss, 4207 Tanglewood Dr., Allison Park, Pa. 15101

[21] Appl. No.: 17,601

[22] Filed: Feb. 16, 1993

[51] Int. Cl.[5] ..... F23Q 7/12

[52] U.S. Cl. ..... 431/255

[58] Field of Search ..... 431/255

[56] References Cited

U.S. PATENT DOCUMENTS 4,348,172 9/1982 Miller .
4,526,532 7/1985 Nelson .
4,720,259 1/1988 Day .
4,804,324 2/1989 Yoshinaga .
4,881,894 11/1989 Chapin .
4,886,447 12/1989 Goss .
4,952,138 8/1990 Ho .
4,954,078 9/1990 Nelson .
5,071,342 12/1991 Yoshinaga .
5,123,837 6/1992 Farnham .

*Primary Examiner*—Carroll B. Dority

*Attorney, Agent, or Firm*—Clifford A. Poff

[57] ABSTRACT

An ignitor housing wherein a piezoelectric device is supported is releasably attached to a backpiece of a torch tip assembly. The housing surrounds air inlet openings to allow passage of a high tension wire from the piezoelectric device to a support site downstream of the gas flow direction where spark gap is established. An actuator button for the piezoelectric device is closely adjacent to the support site for the torch to enable the operator to operate the button while supporting and controlling the torch with one hand. The site of the actuator button is very favorable for resisting the reaction forces to the actuating force on the button. The housing is constructed to enable replacement of internal components of the ignitor as well as replacement of the housing on the backpiece. The housing can be made from any of variety of materials because the support site on the backpiece always remains cool during operation of the torch. In all embodiments, the torch includes a replaceable tip for a gas supply and supports the ignitor housing.

12 Claims, 6 Drawing Sheets

DETACHABLE IGNITOR TIP FOR A BURNER ASSEMBLY

BACKGROUND OF THE INVENTION

1. Field of the Invention

This invention relates to a burner assembly having an accessible ignitor on a torch tip wherein an ignitor actuated by a push button is mounted on a back piece to circumscribe a mixing chamber for air and gas such as acetylene, Mapp, propane, or the like; and more particularly, to such an tip wherein an actuator button for a piezoelectric ignitor is orientated for actuation by applying a force in the direction opposite to a torch handle or torch regulator assembly to which the ignitor tip is detachably connected.

2. Description of the Prior Art

It is well known practice to ignite a gas-air mixture formed by a hand-held burner through the use of a spark generating device. An operator first establishes a flow of a combustible air gas mixture emerging from a torch tip and then by holding a spark generating device close to the tip, the occurrence of a spark ignites the combustible air gas mixture. An example of such a burner can be found in my U.S. Pat. No. 4,886,447. Recent developments in this general type of burner provide for the integration of an electrically powered ignitor, e.g., piezoelectric apparatus, with the burner thereby avoiding the need to maintain the separate mechanical spark or flame source.

Examples of a burner assembly having an ignitor combined therewith can be found in the following patents: U.S. Pat. No. 4,348,172; U.S. Pat. No. 4,526,532; U.S. Pat. No. 4,804,324; U.S. Pat. No. 4,720,259; U.S. Pat. No. 4,881,894; U.S. Pat. No. 4,952,138; U.S. Pat. No. 4,954,078; U.S. Pat. No. 5,071,342; and U.S. Pat. No. 5,123,837. From this body of prior art there can be found a disclosure of a torch tip assembly wherein a piezoelectric ignitor and actuator button are mounted on a burner tube at any one of diverse places with regard to air inlet openings for a mixing chamber. In U.S. Pat. Nos. 4,348,172 and 4,881,894 there are disclosed high tension wires for a piezoelectric ignitors extending externally along the burner tubes to sites where an opening is provided in the burner tubes for passage of the high tension wire interiorly of the tubes an thence along the interior of the tubes to selected site where spark gap is formed with the burner tubes. In such an arrangement, the opportunity exists for an unwanted leakage of combustible gas from the openings where the high tension wires pass through the walls of the burner tube. Not only does the opportunity exist for the combustion of the gas leaking from the opening in the burner tube, but also deterioration to insulation due to thermal excursions of the burner tube at the entrance site throughout the operation of the torch.

It is undesirable to expose ignition lead wire to the environment that might allow damage to the lead wire or disconnection from the anchor site. In this regard, when an ignition lead wire enters a burner tube at a site downstream from the ignitor housing, it is prone to failure the attempts to maintain the gas type seal which can be damaged when used or bumped or when stored. Also, the combustible gas stream is completely combustible at a site downstream of a mixing chamber when chosen as an entry site in the burner tube for the lead wire. The lead wire and any attempts to provide a protective enclosure obstructs the operators view of the work area during use of the torch tip. It can also be found from this prior art that a housing with complex construction is utilized for separating and mounting a gas control valve as well as an ignitor onto the basic structure of the gas appliance. The complexity of the housing construction discourages and usually inhibits necessary occurring replacement of the piezoelectric ignitor when it fails service.

When a gas control valve and piezoelectric ignitor are integrated in a burner assembly, should the burner tube of the assembly, for example, be damaged, then the entire assembly including ignitor and gas control valve must be discarded. The burner tube is pone to wear and tear because of the thin wall tube design which also make it subject to damage when dropped or impacted. In the known design, when the ignitor is supported in an housing by a burner tube, the ignitor is too remote to the handle or other hand gripping surface to enable support of the torch by the same hand used to operate the ignitor. Moreover, the stress and stain imparted on the burner tube by the operation of the piezoelectric ignitor requires special measures to protect the burner tube against fatigue. A problem still remains in regard to the degregation of the close tolerance fit and "O" ring used in the quick release connection between the handle and the torch tip assembly. The need exists, therefore, to provide an ignitor housing to fit the back piece of a replaceable ignitor tip and provide a passageway for a high tension wire to the interior of the burner tube in such a manner so as to avoid the possibility of leakage of a combustible gas mixture to the atmosphere.

Accordingly, it is an object of the invention to provide in a burner assembly an ignitor housing affixed to a back piece of a torch tip which is detachable from a torch handle or a torch regulator and always remains impervious to heating throughout operation of the burner assembly to avoid thermal damage to the ignitor housing.

It is a further object of the present invention to provide an ignitor arranged in a torch tip in a manner to allow operation of the ignitor push button by the thumb or finger of the persons hand which also grips and supports the torch handle or regulator.

It is a further object of the present invention to provide a housing which is mounted on the back piece of a torch tip in a manner that will allow dimensioning of the ignitor to fit a multiplicity of differently sized torch tips while protecting the ignitor lead wire through utilization of air inlet openings of a mixing chamber in the back piece for passage in the lead wire to the interior of the burner tube.

SUMMARY OF THE INVENTION

According to the present invention there is provided a torch tip assembly including the combination of a burner tube having a gas discharge end for maintaining combustion of a combustible gas mixture conducted by the burner tube, a back piece supporting a gas discharge nozzle for delivering a combustible gas to a mixing chamber at the discharge end of the nozzle, the mixing chamber being surrounded by a side wall having an opening therein to supply atmospheric air to the mixing chamber, the back piece including a passageway for discharging the combustible gas mixture formed therein to the burner tube, an ignitor housing secured for support by walls of the mixing chamber, the ignitor housing including an upstanding housing portion presenting an end wall disposed oppositely to the burner tube when coupled to the back piece, the housing including an actuator button accessible in the end wall and operatively connected to a piezoelectric ignitor assembly supported in the housing to allow access thereto, a conductor wire connected to the piezoelectric ignitor assembly for extending from the housing through the opening in the mixing chamber and thence along the burner tube to an anchor site, the ignitor housing surrounding the mixing chamber and including openings to supply atmospheric air to the opening in the mixing chamber, and means to form a spark gap with the conductor wire for igniting the flow of combustible gas mixture conducted by the burner tube.

According to another aspect of the present invention there is provided a torch tip assembly which includes the combination of a burner tube having entry and discharge ends, a back piece including an air fuel mixing chamber wherein air is drawn from openings in the side wall of the mixing chamber to form a combustible gas by mixture with a gas stream emerging from a gas discharge nozzle at the entrance of the mixing chamber, an ignitor housing secured for support by walls of the mixing chamber, the ignitor housing including an upstanding housing portion presenting an end wall disposed oppositely to the burner tube when coupled to the back piece, the end wall having an actuator button therein, the housing further including a cavity wherein the piezoelectric ignitor assembly is supported for actuation by the button, the piezoelectric ignitor assembly having a conductor wire extending from the housing through an opening of the mixing chamber and thence to an anchor site upstream in the gas flow direction of the discharge end of the burner tube, means for anchoring the conductor wire to form a spark gap, and a means coupled to the piezoelectric ignitor assembly to establish the burner tube at a ground potential with respect to the conductor wire.

BRIEF DESCRIPTION OF THE DRAWINGS

These features and advantages of the present invention as well as others will be more fully understood when the following description is read in light of the accompanying drawings in which.

DETAILED DESCRIPTION OF THE PREFERRED EMBODIMENTS

Figure 1:
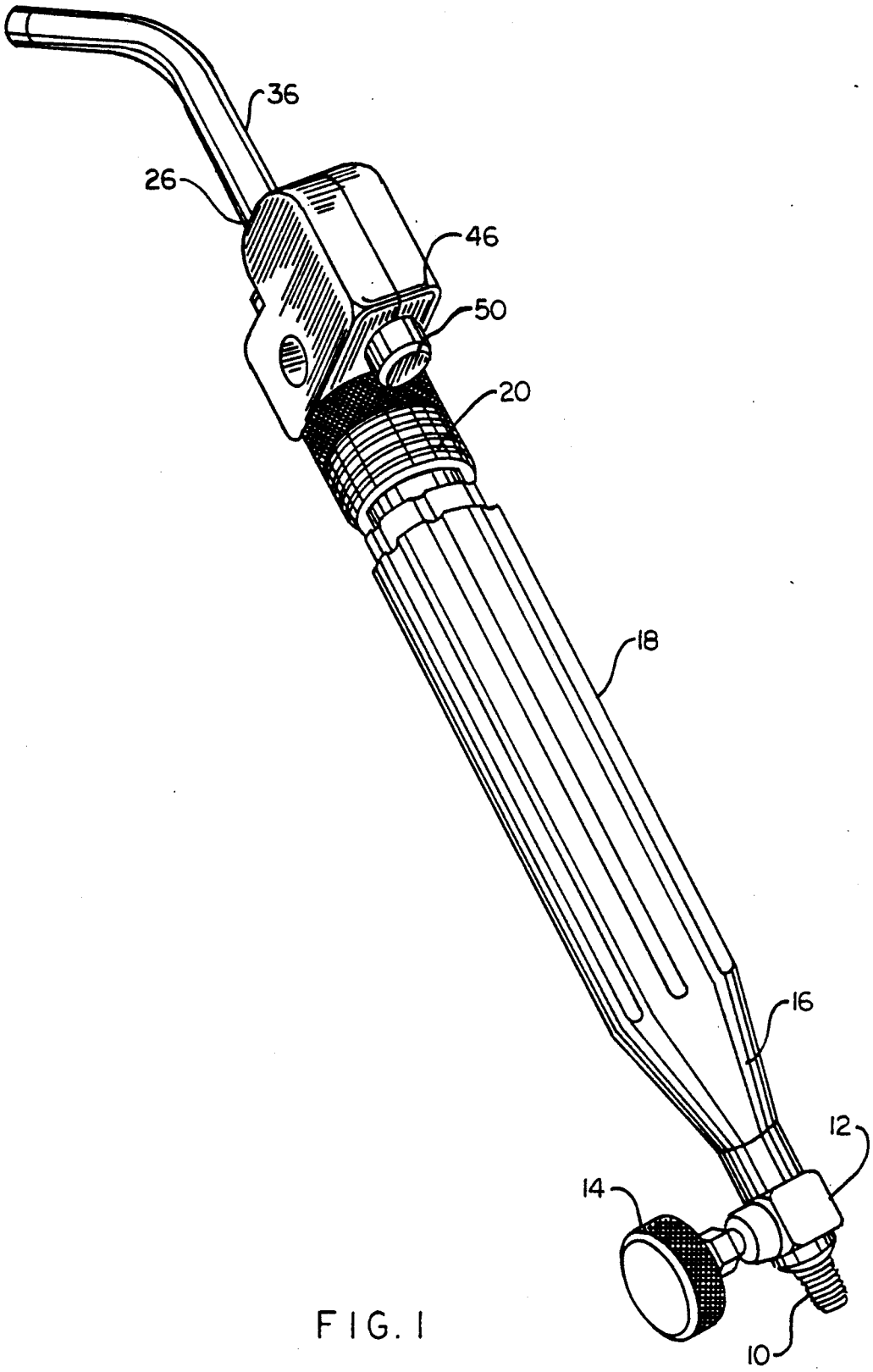
FIG. 1 is an isometric view of a burner assembly having a detachable torch ignitor tip according to a preferred embodiment of the present invention.
Figure 2:
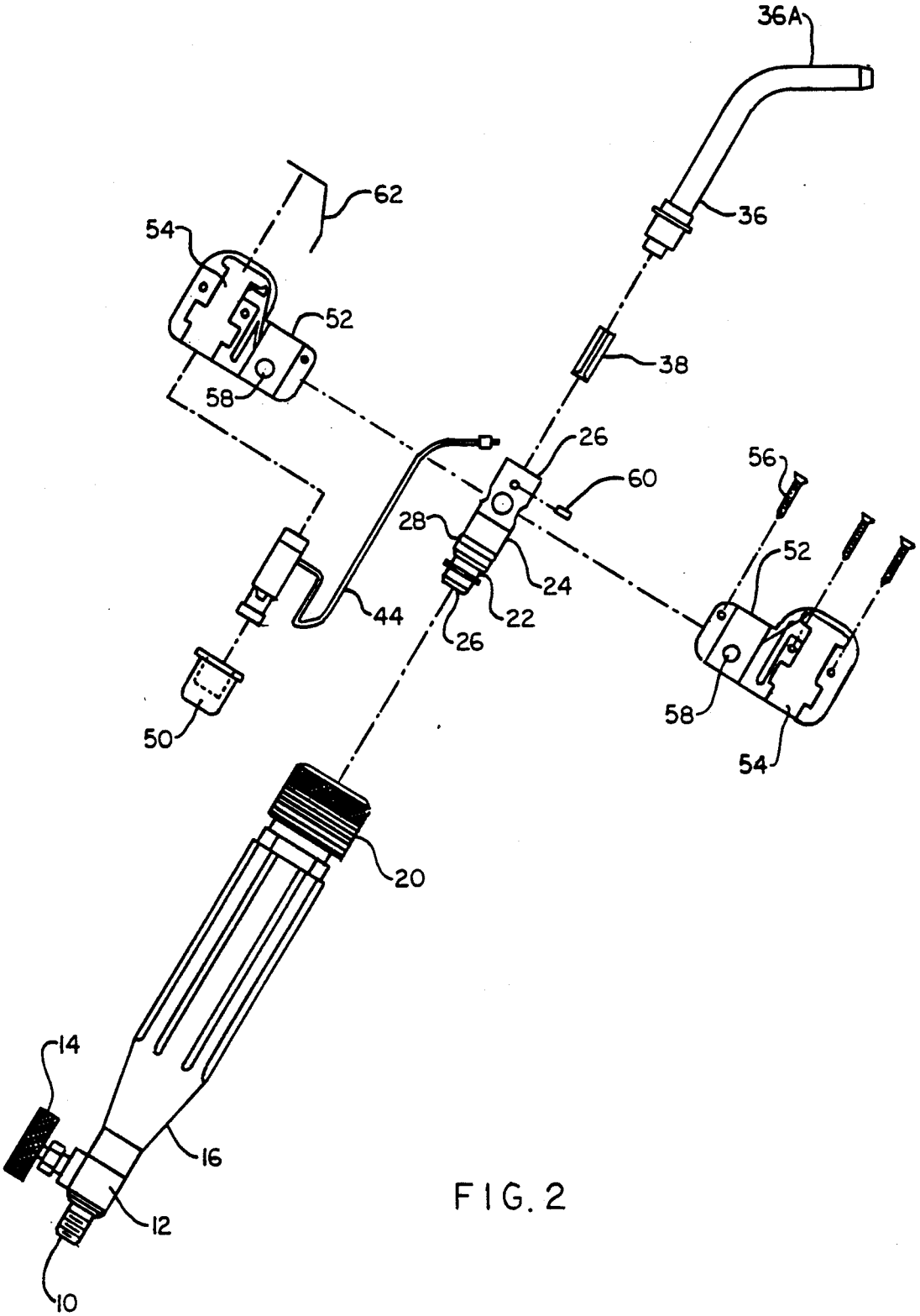
FIG. 2 is an exploded view of the torch tip shown in FIG. 1.
Figure 3:
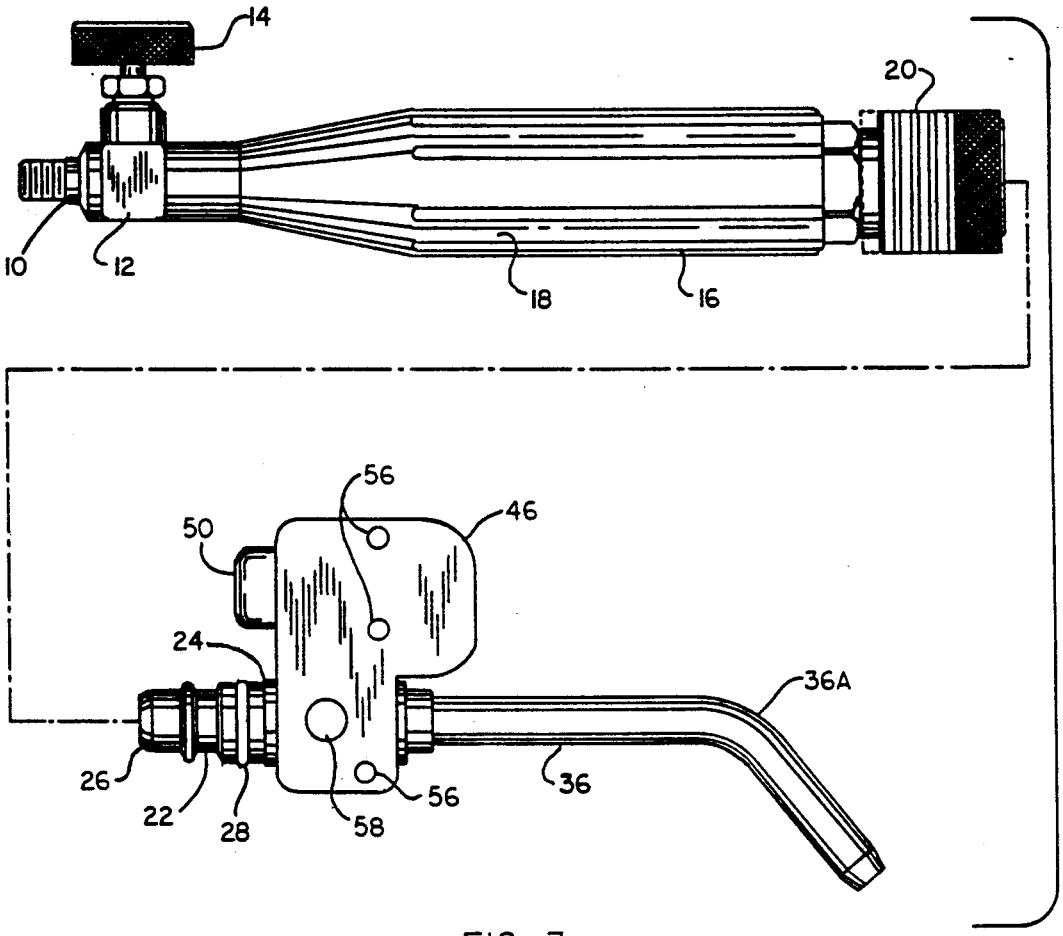
FIG. 3 is an exploded side elevational view of the burner assembly shown in FIG. 1.

FIGS. 1-3 illustrate a burner assembly 10 which, according to the preferred embodiment of the present invention, is a gas appliance of the type which receives a supply of a gaseous fuel from the pressure vessel and typically is acetylene, Mapp or propane gas. The gas supply is delivered by a flexible conduit, not shown, that is joined by a threaded connection to a control valve 12 having a gas flow control knob 14 to turn ON and select a desired gas flow rate. The gas is conducted along a conduit that is encased by a plastic housing 16 and provided with longitudinally extending external ribs 18 forming a gripping surface by which a user can support the housing in the palm of the hand with ease throughout a long period of use of the gas appliance. A gas regulator, per se well known in the art, can be used in place of the handle without departing from the present invention. At the gas discharge end of the handle there is a spring biased collar 20 which can move to and frog on the gas conduit to secure a locking dedent ball in a locked position and an unlocked position. In the unlocked position, a dedent ball in the locking collar is free to retreat away from an annular recess 22 formed in the back piece 24 of a torch tip assembly 26. In the locked position, the dedent ball in the locking collar is held to remain in the recess 22 when the back piece is fitted into the end portion of gas conduit of the handle. An O-ring 28 supplies a stabilizing and supporting function to the back piece. A different "O" ring in the collar 20 forms a gas-tight seal between the back piece and the gas conduit.

Figure 4:
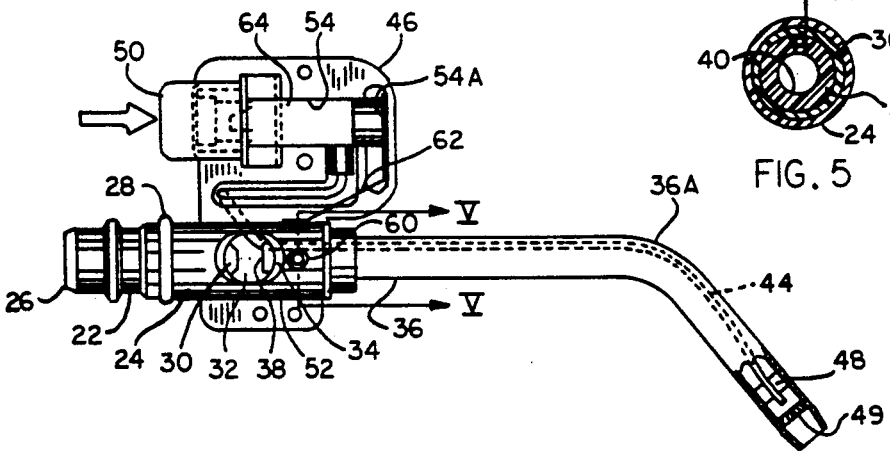
FIG. 4 is a sectional view illustrating the interior of the ignitor housing with one of the divided halves of an ignitor housing removed.
Figure 5:
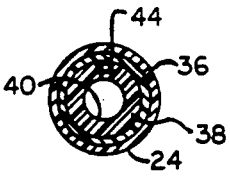
FIG. 5 is an enlarged sectional view taken along lines V—V of FIG. 4.
Figure 6C:
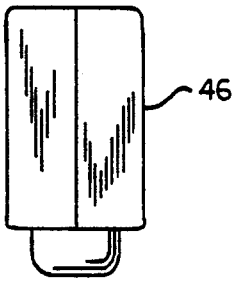
FIGS. 6A–6F are end elevational, left elevational, top, right elevational bottom and front views, respectively, of the ignitor housing shown in FIGS. 1–4.
Figure 6B:
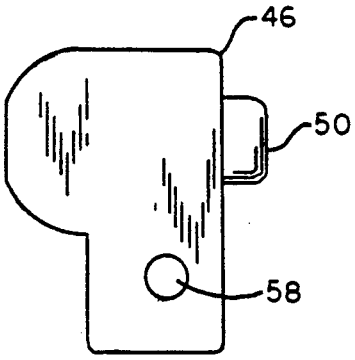
Figure 6A:
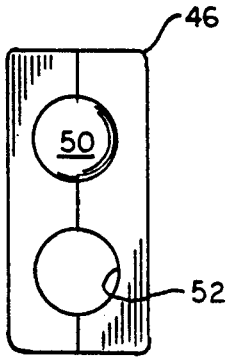
Figure 6D:
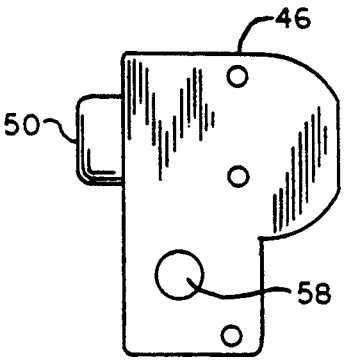
Figure 6E:
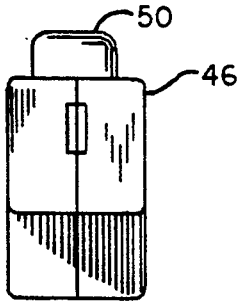
Figure 6F:
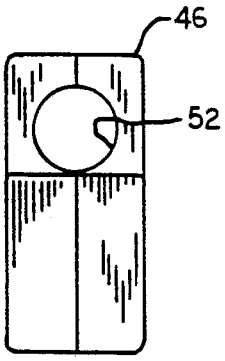
Figure 7A:
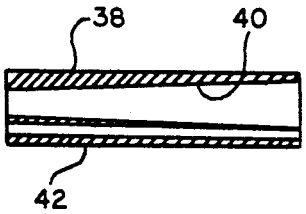
FIG. 7A is a longitudinal sectional view through a venturi forming part of an ignitor tip according to a preferred embodiment of the present invention.
Figure 7B:
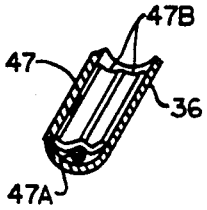
FIG. 7B is an isometric view of a retainer for a wire of an ignitor of the present invention.

The back piece 24 embodies a construction, as generally shown in my U.S. Pat. No. 4,886,447, and includes, as best shown in FIG. 4, an internal passageway in which there is threadedly received the gas discharge orifice 30 arranged to discharge a stream of gas from an orifice opening to a mixing chamber 32 surrounded by tubular walls of the back piece 22 and formed with an array air inlet openings 34 to supply atmospheric air to the mixing chamber. A combustible mixture of air and gas is formed in the mixing chamber and discharged from the back piece into the entry end of a burner tube 36. In the preferred embodiment and as shown in FIGS. 2, 4 and 7A, the burner tube at the gas entry end of tube supports by frictional engagement, a plastic insert 38 forming a venturi 40 to accelerate the gas flow from the mixing chamber into the burner tube and provide a support passageway 42 extending generally parallel to the flow of gases in the venturi 40. The passageway 42 is used, according to the preferred embodiment, to protectively house and guide a high tension electrical conducting wire 44 that enters the back piece through one of air inlet openings 34 from an ignitor housing 46. An important feature of the present invention provides that the ignitor housing 46 is supported and secured to the back piece where the air inlet openings 34 are present. At this site, conductive heat transfer by the burner tube does not occur. When a venturi is not used, the plastic insert 38 is eliminated. As shown in FIG. 7B, the high tension lead wire may be held in a position against the side wall by a retainer 47 having a bent configuration to form a wire holding passageway 47A, as shown, and attachment sites 47B for welding or otherwise affixing the retainer 47 to the interior of the burner tube.

Wire 44 extends when emerging from the passageway 42 in the event a venturi is used or passageway 47A where a venturi is not used, generally along an internal sidewall of the burner tube to an anchor site formed by a wire clip 48 used to support the high tension lead wire in the burner tube at a position where the terminal end of a wire is at a proper distance from the wall of the burner tube to allow a spark to jump from the wire to the tube and ignite the combustible fuel mixture conveyed by the tube. A preferred clip design provides that the wire 44 is directly connected to the clip and the clip is directly supported by the wall of the burner tube. The spark site is immediately upstream of a flame holder, when used, but is always upstream of the gas discharge end of the burner tube. The flame holder may be of any diverse constructions including the construction shown in my U.S. Pat. No. 4,886,447. The flame holder takes the form of a slug 48 having a disk-like shape with drilled passageways to direct the combustible gas mixture in a preselected angle relation so that the combustible gas mixture burns in a desired fashion at the discharge end of the burner tube. The factors effecting the manner of combustion include not only the type of gaseous fuel and the diameter of a burner tube but also presence or lack of or type of flame holder and presence or lack of a venturi. Also relevant to the combustible process is the gas flow rate.

An important part of the present invention allows use of the ignitor housing with any of a diverse variety of burner tip assemblies 26. In this regard while a given torch tip assembly may have a burner tube with a preselected diameter and slug configuration for a particular purpose, it is possible, according to the present invention, to affix the burner assembly to a back piece having a diameter that does not vary from burner tube assembly to burner tube assembly. Moreover, the registration of the air inlet opening 34 can be controlled with respect to the bend 36A in the burner tube 36 so that an upstanding part of the ignitor housing 46 always presents an ignitor actuating button 50 toward and in a generally confronting relation to the users hand when engaged and supporting the burner assembly 10.

The present invention utilizes the back piece 24 as the anchor site for the ignitor housing 46 so as to minimize all adverse effects due to a force couple occurring when the push button 50 is operated by the user. In this regard, the force exerted on the push button imposes a force couple which is minimized by the location of the housing and is resisted by the closely fitting parts forming the threaded connection to the gas supply or a quick release coupling including the locking dedent ball, the "O" ring 28 and the closely fitting ring section forming part of the annular recess 22. Not only can the back piece 24 be readily constructed in a robust manner, but also the external dimensions of the back piece can be uniform so as to accommodate all of a variety one of differently sized burner tubes.

The actuator housing is made in two halves and form internal cavities 52 and 54. Threaded fasteners 56 join the housing halves together thus establishing cavity 52 as an open ended cylindrical cavity whose diameter corresponds to the outside diameter of the wall of the back piece which surrounds the mixing chamber 32. After the inlet openings 34 are brought into registration with air supply passageways 58 formed in the sidewalls of the ignitor housing defining cavity 52 supply passageways 58 a locking pin 60 is placed to extend between an opening in the back piece and an aligned opening in the ignitor housing. During the assembly process, the burner tube 36 is secured in the opening of the back piece by any of various conventional measures including, for example, a threaded connection or crimping. The connection is dependent upon the manufacturing technique utilized and may be dependent on the necessity to bend the burner tube after the position of the ignitor housing is established with respect to the back piece. It is desirable and usually necessary that the upstanding relation of the ignitor housing on the back piece fall in the plane that also contains the bent end portion of the burner tube.

The cylindrical cavity 52 also presents an exposed end portion of a ground strap 62 which is a bent piece of electrically conductive metal having an inwardly bent configuration supported in the ignitor housing for electrically connecting the back piece to an output terminal of piezoelectric ignitor assembly 64. The piezoelectric ignitor assembly is of a type readily available in the industry and supported in cavity 54 against an end wall 54A where a terminal end portion of the strap 62 is also located. The conducting wire 44 emerging from the inlet opening 34 enters a torturous passageway formed in the ignitor housing to anchor the conducting wire 44 and direct the wire into electrical contact with an output terminal of the piezoelectric ignitor assembly. The actuator button is supported in the cavity 54 to abut against and operatively displace an actuating element of the piezoelectric ignitor assembly. The serviceability of the ignitor is enhanced by the divided construction of the housing which allows access to the piezoelectric ignitor assembly for its replacement as well as reconnecting of the conducting wire 44 in the housing when the burner tip is replaced by disconnecting it from the back piece may be necessary from time to time. The divided construction of the housing also enables servicing the electrical connection between the piezoelectric ignitor assembly and the back piece by the bent metal strip. The anchor pin is also serviceable for replacement of the ignitor housing on the back piece, should this be necessary or desired.

Figure 8:
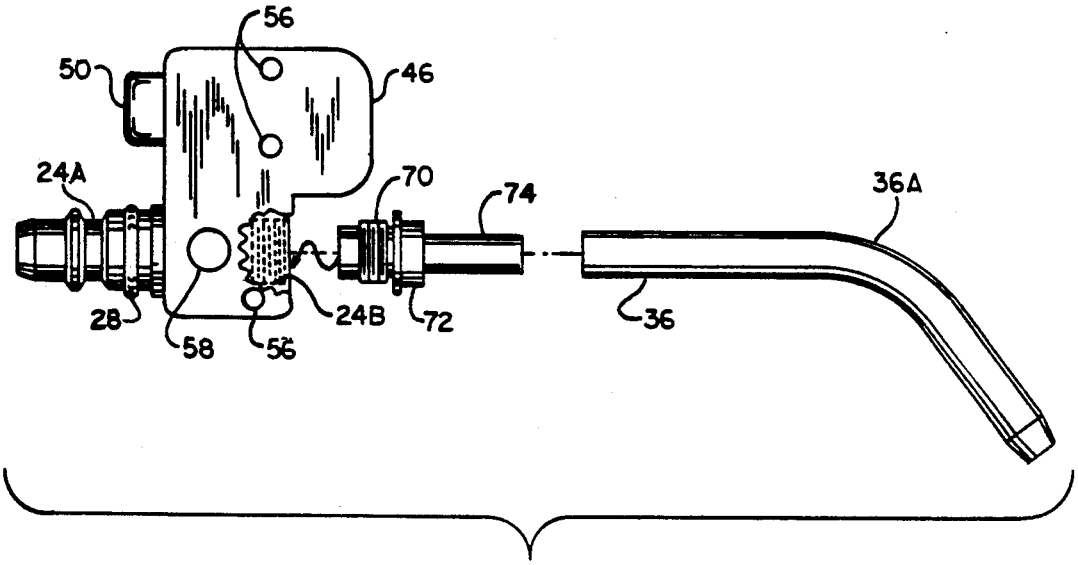
FIG. 8 is an exploded view of a torch tip assembly according to a second embodiment of the present invention.

FIG. 8 illustrates a second embodiment of the present invention in which the back piece 24A at the gas discharge end 24B is formed with internal threads for mating engagement with external threads 70 on an end socket 72. Socket 72 has an internal opening of a dimension that is suitable to receive, if desired, the insert 38 for support of the venturi 40 as well as provide support for high tension wire extending from the piezoelectric generator to the anchor site downstream in the burner tube. The construction shown in FIG. 8 shows the added advantage that the gas discharge orifice can be accessible and inserted into the backpiece 24A through the opening defined by the threaded portion 24B. Moreover, during the assembling of the torch tip assembly, the burner tube 36 can be passed onto an anchor sleeve 74 forming part of the socket 72 and crimped, welded or otherwise attached for permanent operation. This construction has the advantage of allowing pre-bending of the burner tube and oriented the bend 36A in the desired relation to the upstanding portion of the ignitor housing.

Figure 9:
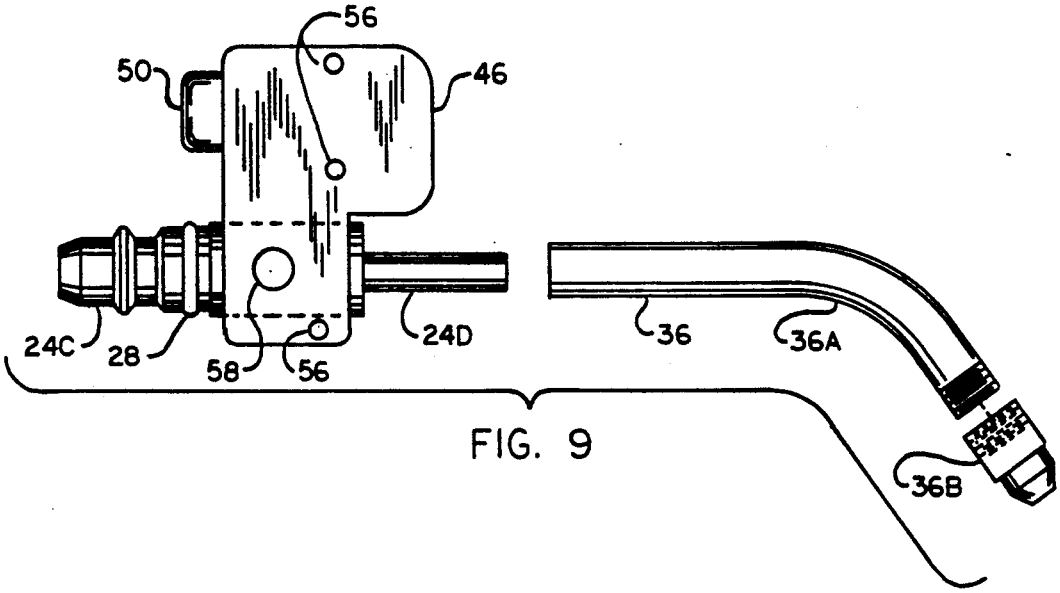
FIG. 9 is an exploded view of a torch tip assembly according to a third embodiment of the present invention.
Figure 10:
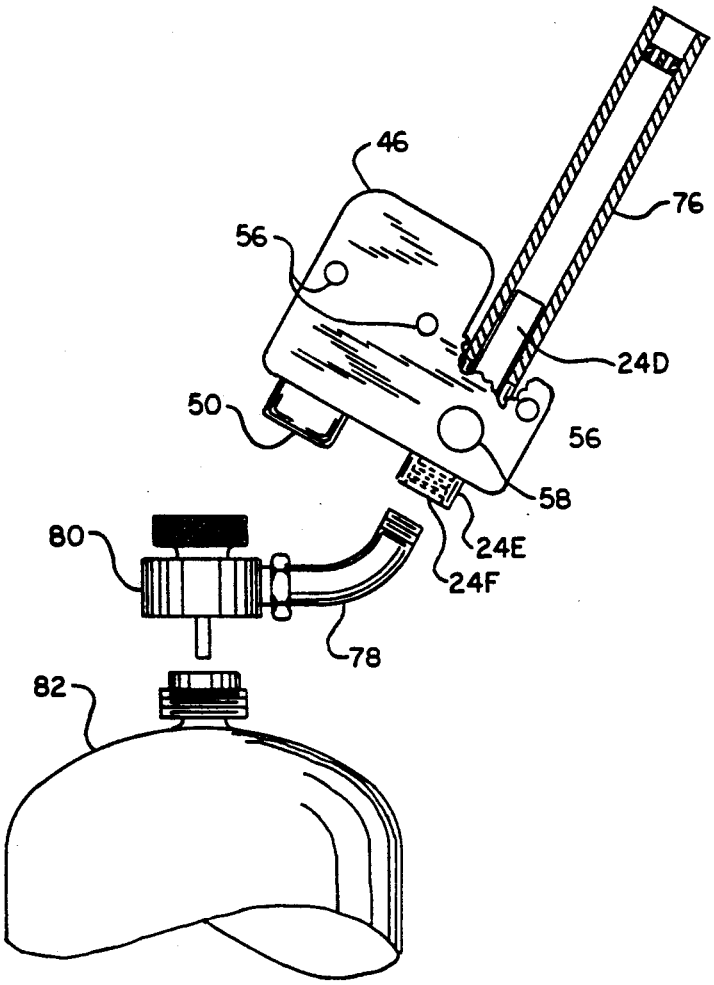
FIG. 10 is an exploded view of a fourth embodiment of the present invention.

FIG. 9 illustrates another embodiment of the present invention in which the backpiece 24C has a protruding burner tube support 24D wherein, if desired, insert 38 may be supported or alternatively, retainer 47 may be utilized to support the high tension wire for the piezoelectric ignitor and prevent unwanted obstruction to the gas flow space inside burner tube support 24D. FIG. 10 illustrates an embodiment wherein the backpiece 24E is provided with the same burner tube support 24D as shown and described in regard to FIG. 9 for engagement with a burner tube 36 which, unlike the other embodiments, takes the form of a straight tubular member having an inside diameter that will pass onto the support 24D and allow clamping or welding engagement therewith. When desired, threads are formed on the downstream end of the burner tube 36 for threadedly engaging and supporting a tip end 36B. Such a tip establishes the site for combustion of gases. Unlike the embodiment of FIG. 9, the embodiment of FIG. 10 provides a internally threaded opening 24F to threadedly engage with the discharge end of a gas delivery pipe 78 extending from a regulator 80 which includes a flow control valve. Regulator 80, in a manner well known in the art, per se, can be threadedly engaged with a hand-held gas propane storage vessel.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. A torch tip assembly including the combination of:

a burner tube having a gas discharge end for maintaining combustion of a combustible gas mixture conducted by the burner tube;

a back piece supporting a gas discharge nozzle for delivering a combustible gas to a mixing chamber formed in said back piece at the discharge end the nozzle, said mixing chamber being surrounded by a side wall having an opening therein to supply atmospheric air to the mixing chamber, means for removable attaching said back piece to said burner tube, said back piece including a passageway for discharging the combustible gas mixture formed therein to said burner tube;

an ignitor housing secured for support by walls of said mixing chamber, said ignitor housing including an upstanding housing portion presenting an end wall disposed oppositely to the burner tube when coupled to said back piece, said housing including an actuator button accessible in said end wall and operatively connected to a piezoelectric ignitor assembly supported in said housing to allow access thereto, a conductor wire connected to said piezoelectric ignitor assembly for extending from the housing through the opening in the mixing chamber and thence along said burner tube to an anchor site, said ignitor housing surrounding said mixing chamber and including openings to supply atmospheric air to the opening in the mixing chamber; and means to form a spark gap with said conductor wire for igniting the flow of combustible gas mixture conducted by said burner tube.

2. The torch tip assembly according to claim 1 further including means releasably connected to said back piece for supplying combustible gas to said gas discharge nozzle.

3. The torch tip assembly according to claim 2 wherein said means includes a spring loaded collar operable with a dedent ball to form the releasable connection with said back piece.

4. The torch tip assembly according to claim 3 including a handle and wherein said actuator button is directed toward and accessible from said handle.

5. The torch tip assembly according to claim 1 wherein said ignitor housing includes a tortious path for anchoring said conductor wire while extending from said piezoelectric ignitor assembly to said burner tube.

6. The torch tip assembly according to claim 5 wherein said tortious path protectively houses said conductor wire.

7. The torch tip assembly according to claim 1 wherein said ignitor housing includes cavities interconnected by a conductor strip for connecting said piezoelectric ignitor assembly to said back piece.

8. The torch tip assembly according to claim 1 further including the means for securing said ignitor housing to said back piece in a position to maintain communication between the opening in the ignitor housing and the openings in the mixing chamber.

9. The torch tip assembly according to claim 1 further including a venturi supported by said burner tube for directing a flow of combustible gas from said mixing chamber to the burner tube and for supporting said conductor wire for passage from said back piece to said burner tube.

10. A torch tip assembly including the combination of:

a burner tube having entry and discharge ends;

a flame holder supported by said burner tube, said flame holder having a passageway for guiding the combustible gas mixture to a combustion site at said discharge end;

a back piece including an air fuel mixing chamber wherein air is drawn from openings in the side wall of the mixing chamber to form a combustible gas by mixture with a gas stream emerging from a gas discharge nozzle at the entrance of the mixing chamber means for removable attaching said burner tube to said back piece;

an ignitor housing secured for support by walls of said mixing chamber, said ignitor housing including an upstanding housing portion presenting an end wall disposed oppositely to the burner tube when coupled to said back piece, said end wall having an actuator button therein, said housing further including a cavity wherein a piezoelectric ignitor assembly is supported for actuation by said button, said piezoelectric ignitor assembly having a conductor wire extending from the housing through an opening of the mixing chamber and thence to an anchor site upstream in the gas flow direction of said flame holder;

means for anchoring said conductor wire to form a spark gap; and a means coupled to said piezoelectric ignitor assembly to establish said burner tube at a ground potential with respect to said conductor wire 11. The torch tip assembly according to claim 10 further including a handle assembly having a quick release coupling for joining connection to said back piece.

12. The torch tip assembly according to claim 10 further including a venturi for feeding the combustible gas mixture from said mixing chamber to said burner tube and for supporting said conductor wire.

* * * * *